US006103067A

United States Patent [19]

Stelljes, Jr. et al.

[11] Patent Number: 6,103,067

[45] Date of Patent: Aug. 15, 2000

[54] PAPERMAKING BELT PROVIDING IMPROVED DRYING EFFICIENCY FOR CELLULOSIC FIBROUS STRUCTURES

[75] Inventors: Michael Gomer Stelljes, Jr., West Chester; Paul Dennis Trokhan, Hamilton; Glenn David Boutilier, Cincinnati, all of Ohio

[73] Assignee: The Procter & Gamble Company, Cincinnati, Ohio

[21] Appl. No.: 09/056,350

[22] Filed: Apr. 7, 1998

[51] Int. Cl.[7] ..... D21F 1/10

[52] U.S. Cl. ..... 162/348; 162/358.1

[58] Field of Search ..... 162/348, 358.1

[56] References Cited

U.S. PATENT DOCUMENTS

| | | | |
|---|---|---|---|
| 4,514,345 | 4/1985 | Johnson et al. | 264/22 |
| 4,528,239 | 7/1985 | Trokhan | 429/247 |
| 4,529,480 | 7/1985 | Trokhan | 162/109 |
| 4,637,859 | 1/1987 | Trokhan | 162/109 |
| 5,098,522 | 3/1992 | Smurkoski et al. | 162/358 |
| 5,260,171 | 11/1993 | Smurkoski et al. | 430/320 |
| 5,274,930 | 1/1994 | Ensign et al. | 34/23 |
| 5,275,700 | 1/1994 | Trokhan | 162/358.1 |
| 5,324,392 | 6/1994 | Tate et al. | 162/348 |
| 5,328,565 | 7/1994 | Rasch et al. | 162/113 |
| 5,334,289 | 8/1994 | Trokhan et al. | 162/358.2 |
| 5,366,798 | 11/1994 | Ostermayer | 428/229 |
| 5,431,786 | 7/1995 | Rasch et al. | 162/348 |
| 5,496,624 | 3/1996 | Stelljes et al. | 428/229 |
| 5,500,277 | 3/1996 | Trokhan et al. | 428/196 |
| 5,503,715 | 4/1996 | Trokhan et al. | 162/296 |
| 5,514,523 | 5/1996 | Trokhan et al. | 430/320 |
| 5,554,467 | 9/1996 | Trokhan et al. | 430/11 |
| 5,556,509 | 9/1996 | Trokhan et al. | 162/111 |
| 5,566,724 | 10/1996 | Trokhan et al. | 139/383 |
| 5,580,423 | 12/1996 | Ampulski et al. | 162/111.7 |
| 5,609,725 | 3/1997 | Phan | 162/117 |
| 5,624,790 | 4/1997 | Trokhan et al. | 430/320 |
| 5,625,961 | 5/1997 | Ensign et al. | 34/117 |
| 5,628,876 | 5/1997 | Ayers et al. | 162/358.2 |
| 5,629,052 | 5/1997 | Trokhan et al. | 427/508 |
| 5,637,194 | 6/1997 | Ampulski et al. | 162/109 |
| 5,674,663 | 10/1997 | McFarland et al. | 430/320 |
| 5,714,041 | 2/1998 | Ayers et al. | 162/111 |

FOREIGN PATENT DOCUMENTS

| | | |
|---|---|---|
| 0 211 426 | 2/1987 | European Pat. Off. . |
| WO 95 33887 | 12/1995 | WIPO . |
| WO 97 26407 | 7/1997 | WIPO . |

OTHER PUBLICATIONS

Robert L. Beran, "The Evaluation and Selection of Forming Fabrics", *Tappi* Apr. 1979, vol. 62, No. 4.

*Primary Examiner*—Christopher A. Fiorilla
*Attorney, Agent, or Firm*—Roddy M. Bullock; Larry H. Huston; Jacobus C. Rasser

[57] ABSTRACT

A papermaking belt including two primary elements: a reinforcing structure and pattern layer. The reinforcing structure includes a web facing first surface of interwoven first machine direction yarns and cross-machine direction yarns, the first surface having an FSI of at least about 68. The reinforcing structure has a machine facing second surface which includes second machine direction yarns binding only with the cross-machine direction yarns in a N-shed pattern, where N is greater than four, wherein the second machine direction yarns bind only one of the cross-machine direction yarns per repeat. The pattern layer extends outwardly from the first surface, wherein the pattern layer provides a web contacting surface facing outwardly from the first surface, the pattern layer extending at least partially to the second surface.

15 Claims, 3 Drawing Sheets

PAPERMAKING BELT PROVIDING IMPROVED DRYING EFFICIENCY FOR CELLULOSIC FIBROUS STRUCTURES

FIELD OF THE INVENTION

The present invention relates to papermaking, and more particularly to belts used in papermaking. Belts of the present invention can reduce energy consumption and improve the drying rate required for thermal drying of paper fibers formed on a three dimensional belt.

BACKGROUND OF THE INVENTION

Cellulosic fibrous structures, such as paper towels, facial tissues, napkins and toilet tissues, are a staple of every day life. The large demand for and constant usage of such consumer products has created a demand for improved versions of these products and, likewise, improvement in the methods of their manufacture. Such cellulosic fibrous structures are manufactured by depositing an aqueous slurry from a headbox onto a Fourdrinier wire or a twin wire paper machine. Either such forming wire is an endless belt through which initial dewatering occurs and fiber rearrangement takes place. Frequently, fiber loss occurs due to fibers flowing through the forming wire along with the liquid carrier from the headbox.

After the initial formation of the web, which later becomes the cellulosic fibrous structure, the papermaking machine transports the web to the dry end of the machine. In the dry end of a conventional machine, a press felt compacts the web into a single region, i.e., uniform density and basis weight, cellulosic fibrous structure prior to final drying. The final drying is usually accomplished by a heated drum, such as a Yankee drying drum.

One of the significant aforementioned improvements to the manufacturing process, which yields a significant improvement in the resulting consumer products, is the use of through-air-drying to replace conventional press felt dewatering. In through-air-drying, like press felt drying, the web begins on a forming wire which receives an aqueous slurry of less than one percent consistency (the weight percentage of fibers in the aqueous slurry) from a headbox. Initial dewatering takes place on the forming wire. From the forming wire, the web is transferred to an air pervious through-air-drying belt. This "wet transfer" occurs at a pickup shoe (PUS), at which point the web may be first molded to the topography of the through air drying belt.

Additional improvements to the web manufacturing process include micropore drying, in which drying is driven primarily by capillary attraction and uniform distribution of air flow. Micropore drying, also known as limiting-orifice through-air drying, is particularly useful for removing interstitial water from the web. Micropore drying typically includes two drying phases. In the first phase, capillary attraction between water and fibers in the web is overcome by vacuum-induced capillary suction which draws the water into the fine capillary network of the micropore drying surface. In the second phase, the fine capillary network of the micropore drying surface helps to uniformly distribute the air that is passed through the paper web. By way of example, micropore drying is described in commonly assigned U.S. Pat. Nos. 5,274,930, issued Jan. 4, 1994 to Ensign et al.; and 5,625,961, issued May 6, 1997 to Ensign et al.; both patents hereby incorporated herein by reference.

Drying efficiency is an issue in all predrying processes. For example, in the process described in the U.S. Pat. No. 5,625,961, the hot air passes through the drying belt first, then through the sheet. Water carried by the drying belt is partially evaporated, thereby reducing sheet drying efficiency. Production rates are thus impacted by the water-carrying characteristics of the drying belt.

In general, through-air-drying preferably dries the web between wet transfer and "dry transfer." At dry transfer, the web is transferred to a heated drum, such as a Yankee drying drum for final drying. During this transfer, portions of the web are densified during imprinting to yield a multi-region structure. Many such multi-region structures have been widely accepted as preferred consumer products.

Over time, further improvements became necessary. A significant improvement in through-air-drying belts is the use of a resinous framework on a reinforcing structure. The resinous framework generally has a first surface and a second surface, and deflection conduits extending between these surfaces. The deflection conduits provide areas into which the fibers of the web can be deflected and rearranged. This arrangement allows drying belts to impart continuous patterns, or, patterns in any desired form, rather than only the discrete patterns achievable by the woven belts of the prior art. Examples of such belts and the cellulosic fibrous structures made thereby can be found in U.S. Pat. Nos. 4,514,345, issued Apr. 30, 1985 to Johnson et al.; 4,528,239, issued Jul. 9, 1985 to Trokhan; 4,529,480, issued Jul. 16, 1985 to Trokhan; and 4,637,859, issued Jan. 20, 1987 to Trokhan. The foregoing four patents are incorporated herein by reference for the purpose of showing preferred constructions of patterned resinous framework and reinforcing type through-air-drying belts, and the products made thereon. Such belts have been used to produce extremely successful commercial products such as Bounty paper towels and Charmin Ultra toilet tissue, both produced and sold by the instant assignee.

As noted above, patterned resinous through-air-drying belts use a reinforcing structure, the reinforcing structure preferably being an interwoven fabric. The reinforcing structure preferably provides sufficient rigidity to the belt, making it durable for papermaking. Without sufficient rigidity, the life of the papermaking belt is compromised, making frequent belt changes necessary. The cost of replacement belts, as well as the cost of the accompanying down time to the papermaking machine is unacceptable for commercial papermaking operations.

The reinforcing structure also has an important function of supporting the fibers fully deflected into the above-mentioned deflection conduits of the resinous framework, thereby enhancing web characteristics, for example, by minimizing pinholing in the web. Fiber support is characterized by a Fiber Support Index, or FSI, and reinforcing structures having an FSI as low as 40 have been found useful. However, to minimize pinholing and to provide a more uniform web surface, it is preferable to have an FSI of at least about 68. As used herein, the Fiber Support Index, is defined in Robert L. Beran, "The Evaluation and Selection of Forming Fabrics," *Tappi* April 1979, Vol. 62, No. 4, which is hereby incorporated herein by reference.

Additionally, the reinforcing structure ideally has low void volume, thereby being low water carrying. By using a low water carrying reinforcing structure, more of the drying energy can be expended drying the paper web, and less expended drying the through-air-drying belt. While void volume and water carrying capacity do not perfectly correlate, in general, water carrying capacity is inherently limited by the available void volume. Therefore, by minimizing the void volume of the reinforcing structure, the water carrying capacity is necessarily minimized as well.

Early through-air-drying belts used a single-layer, fine mesh reinforcing element, typically having approximately fifty machine direction and fifty cross-machine direction yarns per inch. While such a fine mesh was acceptable from the standpoint of being low water carrying, and controlling fiber deflection into the belt (i.e., acceptable Fiber Support Index, as described below), it was unable to withstand the environment of a typical papermaking machine. For example, such a belt was so flexible that destructive folds and creases often occurred. The fine yarns did not provide adequate seam strength and would often burn at the high temperatures encountered in papermaking.

A new generation of patterned resinous framework and reinforcing structure through-air-drying belts addressed some of these issues. This generation utilized a dual layer reinforcing structure having two layers of machine direction yarns. A single cross-machine direction yarn system ties the two layers of machine direction yarns together. The dual layer reinforcing structure added rigidity and resulted in a much more durable belt, able to withstand the aforementioned environment of a typical papermaking machine. However, due to the nature of the weave, the belt caliper and void volume increased, causing the belt to carry much more water through the drying process, resulting in some drying inefficiencies during papermaking. Also, due to the weave pattern on the top layer, dual layer reinforcing structures did not always provide adequate fiber support (i.e., unacceptable Fiber Support Index, as described below), resulting in additional development to minimize undesirable paper characteristics, including pinholes.

Triple layer reinforcing structures were developed, the triple layer belts being essentially a two layer structure with each layer comprising machine direction yarns and cross-machine direction yarns (i.e., warps and shutes). In preferred embodiments, the top layer (i.e., web facing layer) is a square weave. The use of the square weave web-facing layer provides improved fiber support, and increased belt rigidity, as compared to dual layer belts. However, the void volume is higher than dual layer belts, resulting in high water carrying through-air-drying belts. Again, the high water content during processing results in additional energy costs to dry the paper web. Preferred triple layer belts are disclosed in U.S. Pat. Nos. 5,496,624, issued to Stelljes et al. on Mar. 5, 1996; and 5,500,277 issued to Trokhan et al. on Mar. 19, 1996; both patents hereby incorporated herein by reference.

Therefore, multiple layer structures offer sufficient belt rigidity, and may offer sufficient fiber support, but they generally contain high void volumes within the belt, which result in high water carrying capacity. This water content adds to the overall drying requirements of the papermaking process. Belt-carried water decreases the efficiency of through-air-drying processes, especially micropore drying where heated air typically encounters the belt-carried water prior to drying the paper webs. A significant amount of energy is expended to remove water trapped in the interstitial void volume of the belt prior to or during drying of the paper web.

The problem of belt-carried water, and the resulting drying inefficiencies, can be minimized by adding more yarns per inch woven in the same pattern, using monolayer reinforcing structures, using smaller diameter monofilaments in the weave, or combinations of the above. For example, fine-mesh, monolayer structures can be low water carrying due to their low thickness and minimal void volume. However, as mentioned above, such structures are not robust enough for commercial paper making. They are generally unable to withstand the environment of a typical papermaking machine, due to their relatively poor rigidity. Without a certain minimal amount of rigidity, the belt tends to wrinkle, or buckle, such that destructive folds and creases often occur at numerous points in its continuous path during papermaking. The constant bending, kinking, and local flexing quickly causes premature failure of the belt.

Dual-layer structures provide sufficient rigidity, resulting in increased belt life, and indeed are currently used for commercial paper production. However, as previously mentioned, dual layer belts tend to have relatively large void volumes within the reinforcing structure, thereby carrying excess amounts of water through the drying process. The excess amount of water can contribute to the overall energy costs associated with drying by limiting drying rates. Triple layer, and other multiple layer configurations also exhibit high water carrying reinforcing structures.

Accordingly, the prior art required a trade-off between low void volume (for low water carrying capacity) and flexural rigidity (for long belt life). In addition, the prior art required a tradeoff between high open area (for better through-air drying) and a fine mesh top surface weave of the reinforcing structure, (forming a monoplanar web facing surface for better fiber support).

The aforementioned approaches have not been entirely successful at achieving a desirable balance between belt void volume, fiber support, and belt rigidity. Clearly, yet another approach is necessary. The necessary approach recognizes that the web facing yarns should provide maximum fiber support while the machine facing yarns should be configured to provide adequate rigidity for belt life, while only minimally impacting overall void volume.

Accordingly, it would be desirable to provide a papermaking belt that can reduce energy consumption in a paper making process.

Additionally, it would be desirable to provide a patterned resinous through-air-drying papermaking belt that overcomes the prior art trade-off of belt life and reduced water carrying capacity.

Additionally, it would be desirable to provide an improved patterned resinous through-air-drying belt having sufficient fiber support to minimize pinholing of a paper web, low water carrying capability, and sufficient durability to withstand the rigors of commercial papermaking.

Further, it would be desirable to provide an energy-efficient patterned resinous through-air-drying belt which produces an aesthetically acceptable consumer product comprising a cellulosic fibrous structure.

SUMMARY OF THE INVENTION

The present invention is a papermaking belt comprising two primary elements: a reinforcing structure and pattern layer. The reinforcing structure comprises a web facing first surface of interwoven first machine direction yarns and cross-machine direction yarns, the first surface having an FSI of at least about 68. The reinforcing structure has a machine facing second surface which comprises second machine direction yarns binding only with the cross-machine direction yarns in a N-shed pattern, where N is greater than four, wherein the second machine direction yarns bind only one of the cross-machine direction yarns per repeat. The pattern layer extends outwardly from the first surface, wherein the pattern layer provides a web contacting surface facing outwardly from the first surface, the pattern layer extending at least partially to the second surface.

DETAILED DESCRIPTION OF THE INVENTION

Figure 1:
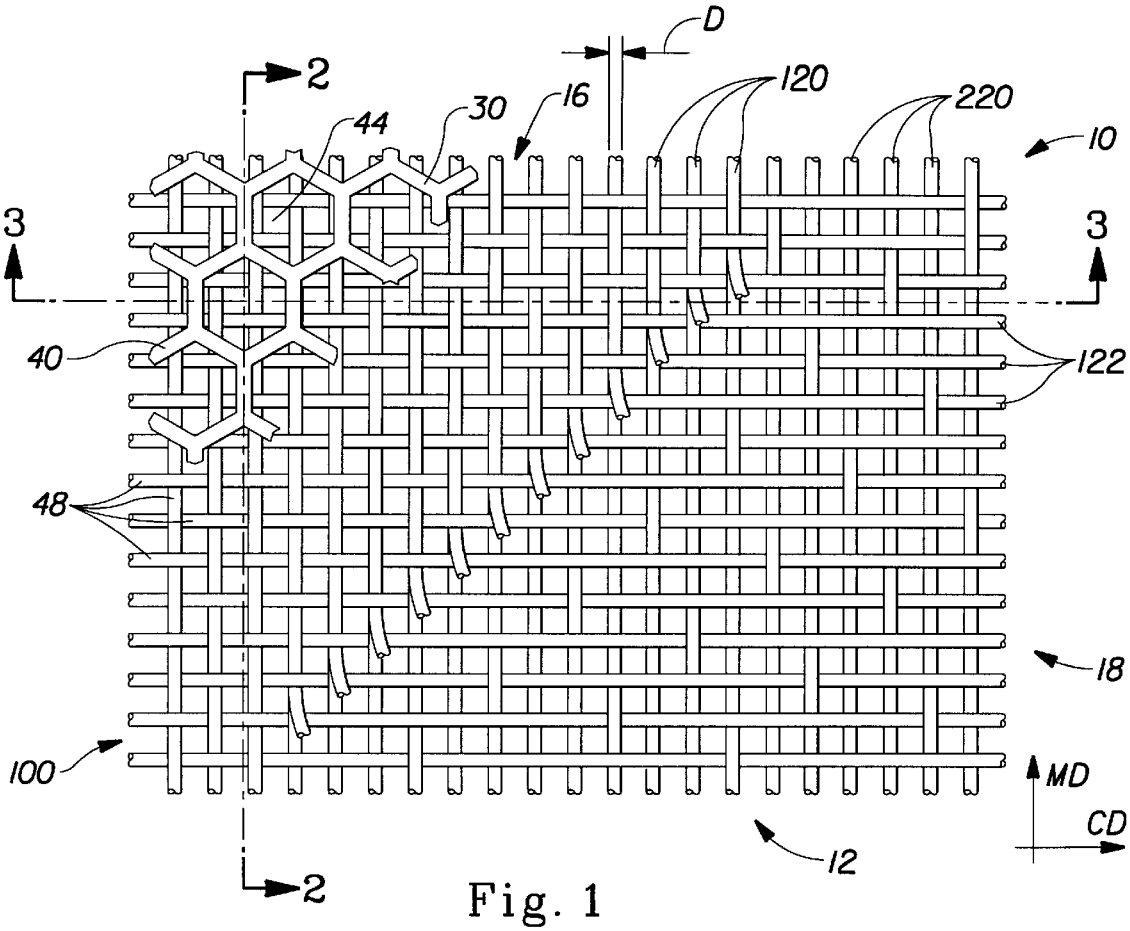
FIG. 1 is a top plan view shown partially in cutaway of a belt according to the present invention having first and second machine direction yarns.
Figure 2:
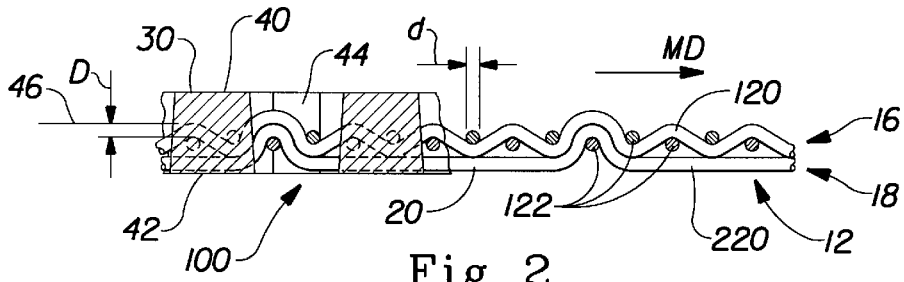
FIG. 2 is a vertical sectional view taken along line 2—2 of FIG. 1 and having the pattern layer partially removed for clarity.
Figure 3:
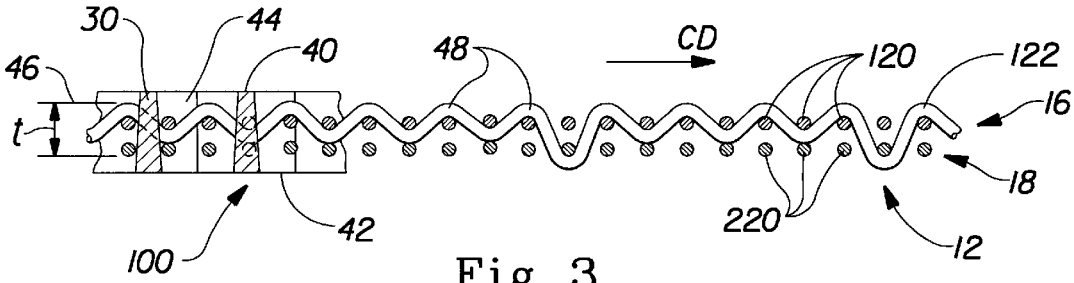
FIG. 3 is a vertical sectional view taken along line 3—3 of FIG. 1 and having the pattern layer partially removed for clarity.

Referring to FIGS. 1–3, the belt 10 of the present invention is preferably an endless belt and may receive cellulosic fibers discharged from a headbox or carry a web of cellulosic fibers to a drying apparatus, typically a heated drum, such as a Yankee drying drum (not shown). Thus, the endless belt 10 may either be executed as a forming wire, a belt for a crescent former, a press felt, a through-air-drying belt, or a limiting orifice through-air-drying belt, as needed. Belt 10 is preferably a patterned resinous through-air-drying belt useful for reducing dewatering energy costs in through air drying operations of papermaking.

The belt 10 of the present invention, comprises two primary elements: a reinforcing structure 12 and pattern layer 30. The reinforcing structure 12 is a structure comprised of interwoven first machine direction (FMD) yarns 120, second machine direction yarns (SMD) 220, and cross-machine direction (CD) yarns 122. First machine direction yarns 120 and cross-machine direction yarns 122 form a web facing first surface 16. Second machine direction yarns 220 and cross-direction yarns 122 form a machine facing second surface 18.

The patterned resinous belt 10 has two opposed surfaces, a web contacting surface 40 disposed on the outwardly facing surface of the pattern layer 30 and an opposed backside surface 42. The web contacting surface 40 may also be referred to as the web facing surface. The backside surface 42 of the belt 10 contacts the papermaking machinery during the papermaking operation, and therefore may be termed the machine facing surface of the papermaking belt. Papermaking machinery (not illustrated) includes vacuum pickup shoes, vacuum boxes, various rollers, and the like.

The pattern layer 30 is cast from photosensitive resin, as described more fully in the aforementioned patents incorporated herein by reference. The preferred method for applying the photosensitive resin forming the pattern layer 30 to the reinforcing structure 12 in the desired pattern is to coat the reinforcing layer with the photosensitive resin in a liquid form. Actinic radiation, having an activating wavelength matched to the curing characteristic of the resin, illuminates the liquid photosensitive resin through a mask having transparent and opaque regions. The actinic radiation passes through the transparent regions and cures, i.e., solidifies, the resin therebelow into the desired pattern. The liquid resin shielded by the opaque regions of the mask is not cured, i.e., remains liquid, and is washed away, leaving the conduits 44 in the pattern layer 30.

As used herein, "yarns 100" is generic to and inclusive of first machine direction yarns 120 of first surface 16, second machine direction yarns 220 of second surface 18, as well as cross-machine direction yarns 122, which occupy portions of both the first and second surfaces. The term "machine direction" refers to that direction which is parallel to the principal flow of the paper web through the papermaking apparatus. The "cross-machine direction" is perpendicular to the machine direction and lies within the plane of the belt 10. A "knuckle" on web facing first surface 16 is the intersection of a machine direction yarn 120 or 220, and a cross-machine direction yarn 122. The "shed" is the minimum number of yarns 100 necessary to make a repeating unit in the principal direction of a yarn 100 under consideration.

In one embodiment of the present invention, the first machine direction yarns 120 in the first surface 16, are woven with cross-machine direction yarns 122 so as to have an FSI of at least about 68, more preferably at least about 80, and most preferably at least about 95. The second machine direction yarns 220 are binding with the cross-machine direction yarns 122 in an N-shed pattern, where N>4. In a more preferred embodiment, as shown in FIGS. 1–3, first surface 16 can be a 2-shed square weave, and machine facing surface 18 can be an 8-shed pattern. As shown, machine-direction yarns 220 are placed under seven and over one cross-direction yarn(s) 122, in a repeating pattern.

The machine direction is also referred to as the "warp", and the second machine direction yarns 120 of the present invention are also referred to as "warp runners", due to the long runs or "backside floats" 20 in the machine facing surface 18 that serve as runners for the reinforcing structure. Therefore, the reinforcing structure of the present invention may also be termed a "warp runner" reinforcing structure. By using a square weave in the first surface 16 of the warp runner reinforcing structure in a belt of the present invention, the deflection of the paper into conduits 44 (described more fully below) is controlled and paper quality, e.g., pinhole reduction, is maintained. Furthermore, by utilizing a second, machine-facing surface 18 having second machine direction yarns 220 with relatively long backside floats, i.e., uninterrupted runs under at least 4 cross machine direction yarns 122 per repeat, belt thickness and void volume are both reduced.

While the Figures show machine direction yarns 120 and 220 in a vertically stacked configuration, the actual configuration of the reinforcing structure is not meant to be so limited. The machine direction yarns may be vertically stacked as shown, especially during manufacture of the reinforcing structure, but in use they may vary substantially from the positions illustrated.

Although the warp runner reinforcing structure described above does exhibit decreased thickness over existing dual layer belts, as well as decreased water carrying capacity, when used alone it is not durable enough for commercial papermaking. This is because the long backside floats 20, upon which the entire belt makes contact with papermaking machinery, are scraped directly against the machinery, such as vacuum boxes. The backside floats relatively quickly abrade and wear to the point of failure, at which time the entire belt fails. Furthermore, the long, uninterrupted backside floats decrease the number of interlocking crimp points, making the weave too "flimsy" or "sleazy" in that the fabric is easily distorted by handling or even by its own weight if not supported. Sleaziness is described as the belt's ability to undergo shear deformation when subjected to in-plane shear forces. Too high a level of sleaziness contributes to early belt failure in commercial papermaking.

It has been surprisingly found that the durability of reinforcing structure 12 can be greatly improved by casting a resinous pattern layer 30 onto reinforcing structure 12, to form the belt 10 of the present invention. The pattern layer 30 penetrates the reinforcing structure 12 and is cured into any desired pattern by irradiating liquid resin with actinic radiation through a binary mask having opaque sections and transparent sections. The cured resinous pattern layer 30 adds rigidity, and reduces sleaziness, both of which increase the durability of the belt 10. Belt durability is also increased due to the protection afforded by the cast resin on the web-facing surface of the reinforcing structure. The resin provides a durable wear surface, giving additional abrasion resistance to the belt 10.

The resinous pattern of the belt 10 may further comprise conduits 44 extending from and in fluid communication with the web contacting surface 40 of the backside surface 42 of the belt 10. The conduits 44 allow deflection of the cellulosic fibers normal to the plane of the belt 10 during the papermaking operation.

Figure 4:
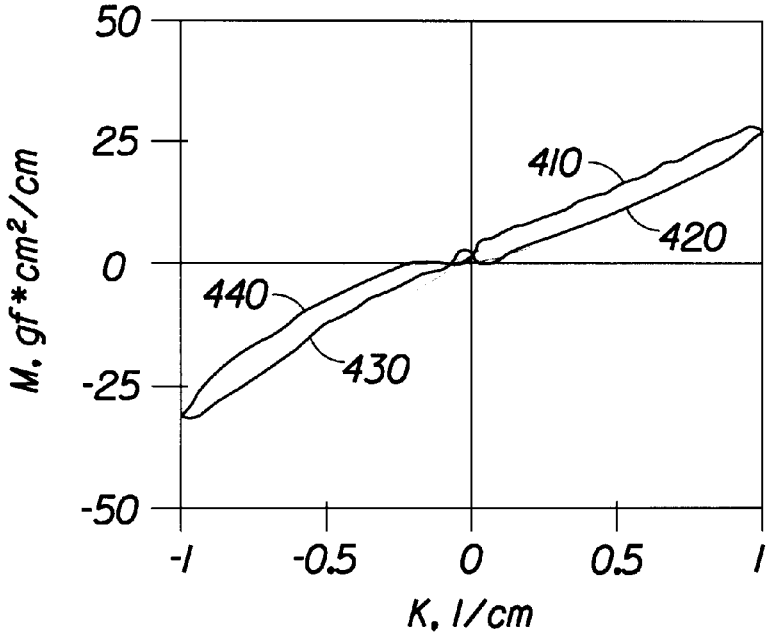
FIG. 4 is a typical graphical representation of the output for a bending stiffness test.

The conduits 44 may be discrete, as shown, if an essentially continuous pattern layer 30 is selected. Alternatively, the pattern layer 30 can be discrete and the conduits 44 may be essentially continuous. Such an arrangement is easily envisioned by one skilled in the art as generally opposite that illustrated in FIG. 1. Such an arrangement, having a discrete pattern layer 30 and an essentially continuous conduit 44, is illustrated in FIG. 4 of the aforementioned U.S. Pat. No. 4,514,345 issued to Johnson et al. and incorporated herein by reference.

Other examples of pattern layer configurations include semi-continuous patterns, such as those disclosed in U.S. Pat. No. 5,714,041, issued to Ayers et al., and configurations producing visually discernible, large scale patterns, such as those disclosed in U.S. Pat. No. 5,431,786 issued to Rasch et al., both patents which are hereby incorporated herein by reference. The belt of the present invention may also be formed having zones with different flow resistances, such as disclosed in U.S. Pat. No. 5,503,715 issued to Trokhan et al., and hereby incorporated herein by reference. Other patterns and configurations may be employed in a belt of the present invention; those listed are meant to be exemplary, and not limiting. Of course, it will be recognized as well that any combination of discrete and continuous patterns may be selected as well.

In addition to application of a resinous pattern on a foraminous belt of woven monofilaments, as described above, a belt of the present invention may further comprise a dewatering felt layer. Methods of applying a curable resin, such as a photosensitive resin, to a substrate, such as a papermaker's dewatering felt, are disclosed in U.S. Pat. No. 5,629,052 issued May 13, 1997 to Trokhan et al.; and U.S. Pat. No. 5,674,663 issued Oct. 7, 1997 to McFarland et al.; both disclosures which are hereby incorporated herein by reference.

Patterned resinous through-air-drying belts made according to the present invention have lower caliper (thickness) than prior art belts, for equal amounts of overburden and comparable mesh counts and filament diameters in the reinforcing structure. "Overburden" refers to the amount of caliper increase due solely to the cured resin, that is, the distance between top plane 46 and web contacting surface 40 The decreased caliper is due to the decrease in caliper of the reinforcing structure utilized in the present invention. A reinforcing structure of the present invention preferably exhibits a caliper reduction of at least about 25% over patterned resinous belts utilizing a current dual-layer reinforcing structures. Of course, the caliper depends upon the diameter and mesh count of the constituent yarn filaments, as disclosed in more detail below.

The lower caliper of belts according to the present invention, together with a preferred weave pattern of the underlying reinforcing structure, contributes to a belt having low void volume, acceptable rigidity, and high FSI. The low void volume and low caliper also contribute to the related benefit of low water carrying capacity, thereby increasing drying efficiency and lowering energy costs.

Therefore, by casting a pattern layer onto the reinforcing structure 12, a durable, commercially viable belt 10 of the present invention is formed. Belt 10 provides for reduced energy consumption in the papermaking process because it overcomes the prior art trade-off of belt life and reduced water carrying capacity. Importantly, because of its high FSI, the belt 10 also produces an aesthetically acceptable consumer product comprising a cellulosic fibrous structure. Detailed disclosure and teaching of preferred embodiments is described below.

Reinforcing Structure

FIGS. 1–3 show a preferred reinforcing structure of the present invention. The first machine direction and cross-machine direction yarns 120, 122 are interwoven into a web facing first surface 16. As shown, the first surface 16 preferably has a one-over, one-under square weave. Preferably the first machine direction and cross-machine direction yarns 120 and 122 comprising the first surface 16 are substantially transparent to actinic radiation. Yarns 120 and 122 are considered to be substantially transparent if actinic radiation can pass through the greatest cross-sectional dimension of the yarns 120 and 122 in a direction generally perpendicular to the plane of the belt 10 and still sufficiently cure photosensitive resin therebelow.

On the reinforcing structure's opposite surface, second machine direction yarns 220, also called "warp runners" are interwoven into a machine facing second surface 18, binding with the cross-machine direction yarns 122 in an N-shed pattern, wherein N>4. The second machine direction yarns 220 are binding with one cross-machine direction yarn 122 per repeat, thereby forming uninterrupted backside floats between repeats. All the constituent yarns may be of equal diameters, but in a preferred embodiment, cross-machine direction yarns 122 are preferably of larger diameter than the first machine direction yarns 120 and second machine direction yarns 220 (if yarns having a round cross section are utilized). For example, machine direction yarns 120 and 220 may be 0.15–0.22 mm in diameter and the cross-machine direction yarns 122 may be 0.17–0.28 mm in diameter, respectively.

Yarns 100 are preferably made of a polymeric material. In particular, in a preferred embodiment first machine direction yarns 120 and cross direction yarns 122 are made of polyester, for example, poly(ethylene terephthalate) (PET), and are substantially transparent to actinic radiation which is used to cure the pattern layer 30. Yarns 120, 122 are considered to be substantially transparent if actinic radiation can pass through the greatest cross-sectional dimension of the yarns 120, 122 in a direction generally perpendicular to the plane of the belt 10 and still sufficiently cure photosensitive resin therebelow.

The reinforcing structure of the present invention has relatively low void volume, thereby being low water carrying. By using a low water carrying reinforcing structure, more of the drying energy can be expended drying the paper web, and less expended drying the through-air-drying belt.

While void volume and water carrying capacity do not perfectly correlate, in general, water carrying capacity is inherently limited by the available void volume. Therefore, by minimizing the void volume of the reinforcing structure, the water carrying capacity is necessarily minimized as well. Representative void volumes for the present invention are shown below in Table 1, in relation to exemplary embodiments.

Additionally, normalized void volume, denoted $N_G$ is a dimensionless number useful for characterizing the void volume of a reinforcing structure in relation to filament diameters. $N_G$ is calculated by dividing void volume per unit area by the largest projected cross-sectional dimension of the largest MD filament, e.g., the diameter of a round cross-section, of the woven reinforcing structure. Reinforcing structures of the present invention have an $N_G$ of less than less than about 2.8, more preferably less than about 2.4, and most preferably less than about 2.0.

Opaque yarns may be utilized to mask a portion of the reinforcing structure 12 between such opaque yarns and the backside surface 42 of the belt 10 to create a backside texture. In the present invention, second machine direction yarns 220 of the second surface 18 may be made opaque, for example, by coating the outsides of such yarns, or by adding fillers such as carbon black or titanium dioxide, etc.

In a preferred embodiment, second machine direction yarns 220 are made of polyester (PET), or polyamide. Depending on the particular pattern cast, it is preferred that the first machine direction yarns 120 and cross direction yarns 122 not differ too much in dimension from one another in order to avoid instability. Normally they have the same dimension, but if different materials are chosen for each, different dimensions may be used to compensate for differing material properties.

One important characteristic of a reinforcing structure of the present invention is its high fiber support, as indicated by its high Fiber Support Index (FSI). By "high fiber support" it is meant that the reinforcing structure of the present invention has an FSI of at least about 68. As used herein, the FSI is defined in Robert L. Beran, "The Evaluation and Selection of Forming Fabrics," *Tappi* April 1979, Vol. 62, No. 4, which is hereby incorporated herein by reference. An FSI at least about 68 allows support of papermaking fibers to be fully deflected into conduits 44, not allowing them to be blown through the belt 10. Accordingly, the yarns 120, 122 of the first surface 16 are preferably interwoven in a weave of N over and N under, where N equals a positive integer, 1, 2, 3 . . . . A preferred weave to achieve a high FSI is a square weave having N=1, i.e., a 2-shed pattern, with high mesh count. (In general, shed=N+1). A mesh count of about 45×49 (machine direction yarns 120×cross-machine direction yarns 122) in a 2-shed pattern is a currently preferred configuration for first surface 16 in a belt 10 of one embodiment of the present invention. This weave exhibits an FSI of about 95. A mesh count of about 34×37 in a 2-shed pattern is also currently preferred, exhibiting an FSI of about 72. It is contemplated that other weaves, including, for example, "Dutch twills", reverse Dutch twills, and other weaves providing adequate FSI's, i.e., greater than about 68, can be used for the web-facing first surface 16.

In accordance with the present invention, the second machine direction yarn 220 may be interwoven in a weave of 1 over, N under, where N equals a positive integer greater than four, thereby providing for a long backside float 20. A preferred weave is 1 over and between 4 and 12 under (5-shed to 13-shed); a more preferred weave is 1 over and between 5 and 9 over (6-shed to 10-shed); and a most preferred weave is 1 over and 7 under (8-shed). Without being bound by theory, it is believed that if N is chosen to be smaller than five, the result will be shorter backside floats which provides less second surface machine direction reinforcement, as well as increased void volume and thickness.

It is desirable that the first surface 16 have multiple and more closely spaced cross-machine direction yarns 122, to provide sufficient fiber support. Generally, the second machine direction yarns 220 of the second surface 18 occur with a frequency coincident that of the machine direction yarns 120 of the first surface 16, in order to preserve seam strength and improve belt rigidity. However, it is contemplated that second machine direction yarns 220 can occur with a frequency less than that of the machine direction yarns 120, for example, in a ratio of 1:2, such that every other first machine direction yarn 120 has a corresponding second machine direction yarn 220.

It is contemplated that the N-shed weave pattern of the second, machine-facing surface of the reinforcing structure can have any of various "warp pick sequences". The phrase "warp pick sequence" relates to the sequence of manipulating the machine direction warp filaments in a loom to weave a fabric as the shuttle is traversed back and forth laying the cross direction shute filaments. As shown in FIG. 1, the warp pick sequence may be 1, 4, 7, 2, 5, 8, 3, 6, yielding a warp pick sequence delta of 3. By warp pick sequence delta is meant the numeric difference between any two consecutive warp designations in the warp pick sequence. For a constant warp pick sequence (as is shown in FIG. 1), the warp pick sequence delta is determined by subtracting the first number from the second in the warp pick sequence. Other warp pick sequences could be used with alternative weaves, similar to the weave illustrated in FIG. 1, without departing from the scope of the present invention. Warp pick sequence is discussed in more detail in U.S. Pat. No. 4,191,609 issued to Trokhan on Mar. 4, 1980, which is hereby incorporated herein by reference.

Contrary to many weave patterns dictated by the prior art, the stabilizing effect of the pattern layer 30 reduces the sleaziness of the fabric, and permits the use of the high-shed pattern of second surface 18, with its inherent low caliper and low void volume. This is because the pattern layer 30 stabilizes the first surface 16 relative to the second surface 18 once casting is complete and throughout the paper manufacturing process. Accordingly, it is believed that shed patterns of 10 shed, or greater, may be utilized for machine facing second surface 18.

The reinforcing structure 12 according to the present invention should allow sufficient air flow perpendicular to the plane of the reinforcing structure 12. The reinforcing structure 12 preferably has an air permeability of at least 800 standard cubic feet per minute per square foot, preferably at least 850 standard cubic feet per minute per square foot, and more preferably at least 900 standard cubic feet per minute per square foot. In certain circumstances, such as in the use of limiting orifice drying, a lower air permeability reinforcing structure may be used with acceptable results. Without being bound by theory, it is believed that this would allow the use of higher mesh counts, which in turn, would increase FSI and reduce void volume. It is contemplated that an FSI as high as 80, or even 95, may be achieved in this manner. Of course the pattern layer 30 will reduce the air permeability of the belt 10 according to the particular pattern selected.

The air permeability of a reinforcing structure 12 is measured under a tension of 15 pounds per linear inch using a Valmet Permeability Measuring Device from the Valmet Company of Helsinki, Finland at a differential pressure of 100 Pascals. If any portion of the reinforcing structure 12 meets the aforementioned air permeability limitations, the entire reinforcing structure 12 is considered to meet these limitations.

In yet another embodiment, the reinforcing structure 12 may further comprise a felt, also referred to as a press felt as is used in conventional papermaking without through-air drying. In this embodiment, it is not necessary that the constituent yarns be transparent to actinic radiation. The pattern layer 30 may be applied to the felt-containing reinforcing structure 12 as taught by commonly assigned U.S. Pat. Nos. 5,556,509, issued Sep. 17, 1996 to Trokhan et al.; 5,580,423, issued Dec. 3, 1996 to Ampulski et al.; 5,609,725, issued Mar. 11, 1997 to Phan; 5,629,052 issued May 13, 1997 to Trokhan et al.; 5,637,194, issued Jun. 10, 1997 to Ampulski et al. and 5,674,663, issued Oct. 7, 1997 to McFarland et al., the disclosures of which are incorporated herein by reference.

Pattern Layer

The pattern layer 30 is cast from photosensitive resin, as described above and in the aforementioned patents incorporated herein by reference.

The pattern layer 30 preferably extends from the backside surface 42 of the second layer 18 of the reinforcing structure 12, outwardly from and beyond the first surface 16 of the reinforcing structure 12. The pattern layer 30 also extends beyond and outwardly from the top surface 46 a distance of preferably about 0.00 inches (0.00 millimeter) to about 0.050 inches (1.3 millimeters), more preferably a distance of about 0.002 inches to about 0.030 inches. The dimension of the pattern layer 30 perpendicular to and beyond the first surface 16 (the overburden) generally increases as the pattern becomes coarser.

Preferably the pattern layer 30 defines a predetermined pattern, which imprints a like pattern onto the paper being made with belt 10. A particularly preferred pattern for the pattern layer 30 of a drying belt used in the drying section of a paper machine is an essentially continuous network. If the preferred essentially continuous network pattern is selected for the pattern layer 30, discrete deflection conduits 44 will extend between the first surface and the second surface of the belt 10. The essentially continuous network surrounds and defines the deflection conduits 44.

The pattern layer 30 of a belt 10 of the present invention may also be a discontinuous, or semi-continuous, pattern. For example, the pattern layer may be applied as taught in commonly assigned U.S. Pat. No. 5,714,041 issued to Ayers et al., on Feb. 3, 1998, and hereby incorporated by reference. Discontinuous pattern layers can find particular utility when the belt 10 of the present invention is used as a forming wire in the forming section of a paper machine, as disclosed in U.S. Pat. No. 4,514,345, issued Apr. 30, 1985 to Johnson et al., which patent is hereby incorporated herein by reference.

The papermaking belt 10 according to the present invention is macroscopically monoplanar. The plane of the papermaking belt 10 defines its X-Y directions. Perpendicular to the X-Y directions and the plane of the papermaking belt 10 is the Z-direction of the belt 10. Likewise, the paper made with a belt according to the present invention can be thought of as macroscopically monoplanar and lying in an X-Y plane. Perpendicular to the X-Y directions and the plane of the paper is the Z-direction of the paper.

The first surface 40 of the belt 10 contacts the paper carried thereon. During papermaking, the first surface 40 of the belt 10 may imprint a pattern onto the paper corresponding to the pattern of the pattern layer 30.

The second, or backside surface 42, of the belt 10 is the machine contacting surface of the belt 10. The backside surface 42 may be made with a backside network having passageways therein which are distinct from the deflection conduits 44. The passageways provide irregularities in the texture of the backside of the second surface of the belt 10. The passageways allow for air leakage in the X-Y plane of the belt 10, which leakage does not necessarily flow in the Z-direction through the deflection conduits 44 of the belt 10.

The belt 10 according to the present invention may be made according to any of commonly assigned U.S. Pat. Nos. 4,514,345, issued Apr. 30, 1985 to Johnson et al.; 4,528,239, issued Jul. 9, 1985 to Trokhan; 5,098,522, issued Mar. 24, 1992; 5,260,171, issued Nov. 9, 1993 to Smurkoski et al.; 5,275,700, issued Jan. 4, 1994 to Trokhan; 5,328,565, issued Jul. 12, 1994 to Rasch et al.; 5,334,289, issued Aug. 2, 1994 to Trokhan et al.; 5,431,786, issued Jul. 11, 1995 to Rasch et al.; 5,496,624, issued Mar. 5, 1996 to Stelljes, Jr. et al.; 5,500,277, issued Mar. 19, 1996 to Trokhan et al.; 5,514,523, issued May 7, 1996 to Trokhan et al.; 5,554,467, issued Sep. 10, 1996, to Trokhan et al.; 5,566,724, issued Oct. 22, 1996 to Trokhan et al.; 5,624,790, issued Apr. 29, 1997 to Trokhan et al.; and 5,628,876, issued May 13, 1997 to Ayers et al., the disclosures of which are incorporated herein by reference.

EXAMPLES OF PREFERRED EMBODIMENTS

Two examples of the present invention, Present Invention I, and Present Invention II, are disclosed below, with important characteristics shown in Table 1 below.

Present Invention I

Present Invention I comprises a reinforcing structure having first machine direction and cross-machine direction yarns 120, 122 of polyester. Yarns 120 and 122 have generally circular cross-sections, with nominal diameters of 0.15 mm and 0.20 respectively, and are interwoven in a one-over, one-under square weave, to form a 2-shed first surface 16. The first machine direction and cross-machine direction yarns 120, 122 comprising the first surface 16 are substantially transparent to actinic radiation which is used to cure the pattern layer 30.

Second machine direction yarns 220, are interwoven into the machine facing second surface 18, binding with the cross-machine direction yarns 122 once per repeat in an 8-shed pattern, in a warp pick sequence of 1, 4, 7, 2, 5, 8, 3, 6 and a warp pick sequence delta of three. The second machine direction yarns 220, which have a generally circular cross-section with a nominal diameter of 0.15 mm, are binding with one cross-machine direction yarn 122 per repeat. The second machine direction yarns 220 are made of polyester containing carbon black, which is opaque to actinic radiation. Having opaque second surface filaments allows for higher precure energy (actinic radiation) and better adherence (lock-on) of the resin to the reinforcing structure, while maintaining adequate backside leakage.

The yarns forming first surface 16 are woven in a square weave having a mesh count of 45 first machine direction yarns 120 per inch, and 49 cross direction yarns 122 per inch. Second machine direction yarns 220 of second surface 18 are woven at 45 yarns per inch, corresponding to the first machine direction yarns 120.

Present Invention I provides a structure having acceptable rigidity, and an FSI of 95. The overall thickness (caliper) of the reinforcing structure 12 of Present Invention I is 0.018 inches (18 mils), the void volume is 0.013 $in^3/in^2$, and the $N_G$ (normalized void volume) is about 2.2, and a CD rigidity of 9.20 gf*cm2/cm. These parameters, i.e., rigidity, FSI, caliper, and void volume, are measured by the test methods described below, and are surprisingly superior to prior art belts. Normalized void volume is calculated by dividing void volume per unit area by the projected cross-sectional dimension of the largest MD filament, e.g., the diameter of a round cross-section, of the woven reinforcing structure. For comparison purposes, Table 1 below shows these parameters for alternative belt designs, including for the present invention. Present Invention I should be compared to the Monolayer I, Dual Layer I, and Triple Layer I belt designs due to their similar mesh counts and filament diameters.

Present Invention II

Present Invention II comprises a reinforcing structure having first machine direction and cross-machine direction yarns 120, 122 of polyester. Yarns 120 and 122 have generally circular cross-sections, with nominal diameters of 0.22 mm and 0.28 respectively, and are interwoven in a one-over, one-under square weave, to form a 2-shed first surface 16. The first machine direction and cross-machine direction yarns 120, 122 comprising the first surface 16 are substantially transparent to actinic radiation which is used to cure the pattern layer 30.

Second machine direction yarns 220, are interwoven into the machine facing second surface 18, binding with the cross-machine direction yarns 122 once per repeat in an 8-shed pattern, in a warp pick sequence of 1, 4, 7, 2, 5, 8, 3, 6 and a warp pick sequence delta of three. The second machine direction yarns 220, which have a generally circular cross-section with a nominal diameter of 0.22 mm, are binding with one cross-machine direction yarn 122 per repeat. The second machine direction yarns 220 are made of polyester containing carbon black, which is opaque to actinic radiation. Having opaque second surface filaments allows for higher precure energy (actinic radiation) and better adherence (lock-on) of the resin to the reinforcing structure, while maintaining adequate backside leakage.

The yarns forming first surface 16 are woven in a square weave having a mesh count of 34 first machine direction yarns 120 per inch, and 37 cross direction yarns 122 per inch. Second machine direction yarns 220 of second surface 18 are woven at 34 yarns per inch, corresponding to the first machine direction yarns 120.

Present Invention II provides a structure having acceptable rigidity, and an FSI of 72. The overall thickness (caliper) of reinforcing structure of Present Invention II is 0.027 inches (27 mils), the void volume is 0.0173 $in^3/in^2$, and the $N_G$ (normalized void volume) is about 2.0. These parameters, i.e., rigidity, FSI, caliper, and void volume, are measured by the test methods described below, and are surprisingly superior to prior art belts. Normalized void volume is calculated by dividing void volume per unit area by the projected cross-sectional dimension of the largest MD filament, e.g., the diameter of a round cross-section, of the woven reinforcing structure. For comparison purposes, Table 1 below shows these parameters for alternative belt designs, including for the present invention. For comparison purposes, Present Invention II is comparable to the Dual Layer II belt design.

TABLE 1

Comparison of Reinforcing Structures

| Reinforcing Structure | Mesh Count (yarns per $in^2$) | Backside Float No. of CD Yarns | Filament Diameters (mm) | Void Volume ($in^3/in^2$) | Normalized Void Volume $N_G$ | Caliper (mils) | CD Rigidity ($gf*cm^2/cm$) | FSI |
|---|---|---|---|---|---|---|---|---|
| Monolayer I | 52 × 52 (MD × CD) | 1 | MD: 0.15 CD: 0.15 | 0.0089 | 1.5 | 12 | 4.46 | 104 |
| Dual Layer I | (2 × 48) × 52 ((2 × MD) × CD) | 3 | 1st MD: 0.15 2nd MD: 0.15 CD: 0.18 | 0.0182 | 3.0 | 24 | 6.96 | 67 |
| Dual Layer II | (2 × 35) × 30 ((2 × MD) × CD) | 3 | 1st MD: 0.22 2nd MD: 0.22 CD: 0.28 | .0282 | 3.3 | 36 | 21.1 | 43 |
| Triple Layer I | 45 × 48/45 × 24 (MD × CD)/(MD × CD) | 1 | 1st MD: 0.15 1st CD: 0.15 2nd MD: 0.15 2nd CD: 0.20 | 0.0186 | 3.1 | 26 | 17.55 | 94 |
| Present Invention I | (2 × 45) × 49 ((2 × MD) × CD) | 7 | 1st MD: 0.15 2nd MD: 0.15 CD: 0.20 | 0.0130 | 2.2 | 18 | 9.20 | 95 |
| Present Invention II | (2 × 34) × 37 ((2 × MD) × CD) | 7 | 1st MD: 0.22 2nd MD: 0.22 CD: 0.28 | .0173 | 2.0 | 26.6 | 22.62 | 72 |

As can be seen by the data shown in Table 1, a monolayer design has a high FSI, and the lowest void volume, including normalized void volume, thereby providing for increased drying efficiency, but it has relatively low rigidity, contributing to low belt life in papermaking. Both dual layer designs have higher rigidity, but very high void volume, including normalized void volume, and relatively high caliper, making their water carrying capacities high, and thus decreasing drying efficiency. The triple layer gives the highest relative rigidity, and very good FSI, but also has a high void volume, normalized void volume, and high caliper, resulting in very high water carrying capacity, and thus, low drying efficiency. The structure of both embodiments of the present invention surprisingly provides for very good rigidity (second only to triple layer belts), very good FSI, low void volume and caliper. Importantly, the reinforcing structures for both Present Invention I and Present Invention II have normalized void volumes near 2.0, approaching the normalized void volume of a monolayer design. Therefore, the structure of the present invention, when formed into a patterned resinous papermaking belt, provides for a low water carrying papermaking belt having good durability, excellent fiber support, and improved drying efficiency.

TEST METHODS

Rigidity

Equipment

Rigidity of the reinforcing structures was measured using a Pure Bending Test to determine the bending stiffness using a KES-FB2 Pure Bending Tester. The Pure Bending Tester is an instrument in the KES-FB series of Kawabata's Evaluation System. The unit is designed to measure basic mechanical properties of fabrics, non-wovens, papers and other film-like materials, and is available from Kato Tekko Co. Ltd., Kyoto, Japan.

The bending property is important for evaluating reinforcing structures and is one of the valuable methods for determining stiffness. The cantilever method has been used for measuring the properties in the past. The KES-FB2 tester is a instrument used for pure bending tests. Unlike the cantilever method, this instrument has a special feature. The whole reinforcing structure sample is bent accurately in an arc of constant radius, and the angle of curvature is changed continuously.

Method

Reinforcing structures were cut to approximately 1.6×7.5 cm in the machine and cross machine direction. The sample width was measured to a tolerance of 0.001 in. using a Starrett dial indicating vernier caliper. The sample width was converted to centimeters. The first (web facing) surface and the second (machine facing) surface of each sample were identified and marked. Each sample in turn was placed in the jaws of the KES-FB2 such that the sample would first be bent with the sheet side undergoing tension and the non-sheet side would undergo compression. In the orientation of the KES-FB2 the first surface was right facing and the second surface was left facing. The distance between the front moving jaw and the rear stationary jaw was 1 cm. The sample was secured in the instrument in the following manner.

First the front moving chuck and the rear stationary chuck were opened to accept the sample. The sample was inserted midway between the top and bottom of the jaws. The rear stationary chuck was then closed by uniformly tightening the upper and lower thumb screws until the sample was snug, but not overly tight. The jaws on the front stationary chuck were then closed in a similar fashion. The sample was adjusted for squareness in the chuck, then the front jaws were tightened to insure the sample was held securely. The distance (d) between the front chuck and the rear chuck was 1 cm.

The output of the instrument is load cell voltage (Vy) and curvature voltage (Vx). The load cell voltage was converted to a bending moment normalized for sample width (M) in the following manner:

$$\text{Moment } (M, \text{gf*cm/cm}) = (Vy*Sy*d)/W$$

where

Vy is the load cell voltage,

Sy is the instrument sensitivity in gf*cm/V, d is the distance between the chucks, and W is the sample width in centimeters.

The sensitivity switch of the instrument was set at 5×1. Using this setting the instrument was calibrated using two 50 gram weights. Each weight was suspended from a thread. The thread was wrapped around the bar on the bottom end of the rear stationary chuck and hooked to a pin extending from the front and back of the center of the shaft. One weight thread was wrapped around the front and hooked to the back pin. The other weight thread was wrapped around the back of the shaft and hooked to the front pin. Two pulleys were secured to the instrument on the right and left side. The top of the pulleys were horizontal to the center pin. Both weights were then hung over the pulleys (one on the left and one on the right) at the same time. The full scale voltage was set at 10 V. The radius of the center shaft was 0.5 cm. Thus the resultant full scale sensitivity (Sy) for the Moment axis was 100 gf*0.5 cm/10V (5 gf*cm/V).

The output for the Curvature axis was calibrated by starting the measurement motor and manually stopping the moving chuck when the indicator dial reached 1.0 $cm^{-1}$. The output voltage (Vx) was adjusted to 0.5 volts. The resultant sensitivity (Sx) for the curvature axis was 2/(volts*cm). The curvature (K) was obtained in the following manner:

$$\text{Curvature } (K, \text{cm}^{-1}) = Sx*Vx$$

where

Sx is the sensitivity of the curvature axis and Vx is the output voltage

For determination of the bending stiffness the moving chuck was cycled from a curvature of 0 $cm^{-1}$ to +1 $cm^{-1}$ to −1 $cm^{-1}$ to 0 $cm^{-1}$ at a rate of 0.5 $cm^{-1}$/sec. Each sample was cycled continuously until four complete cycles were obtained. The output voltage of the instrument was recorded in a digital format using a personal computer. A typical graph output is shown in FIG. 4. At the start of the test there was no tension on the sample. As the test begins the load cell begins to experience a load as the sample is bent. The initial rotation was clockwise when viewed from the top down on the instrument.

In the forward bend the first surface of the fabric is described as being in tension and the second surface is being compressed. The load continued to increase until the bending curvature reached approximately +1 $cm^{-1}$ (this is the Forward Bend (FB) as shown in FIG. 4). At approximately +1 $cm^{-1}$ the direction of rotation was reversed. During the return the load cell reading decreases. This is the Forward Bend Return (FR). As the rotating chuck passes 0 curvature begins in the opposite direction, that is the sheet side now compresses and the no-sheet side extends. The Backward Bend (BB) extended to approximately −1 $cm^{-1}$ at which the direction of rotation was reversed and the Backward Bend Return (BR) was obtained.

Figure 5:
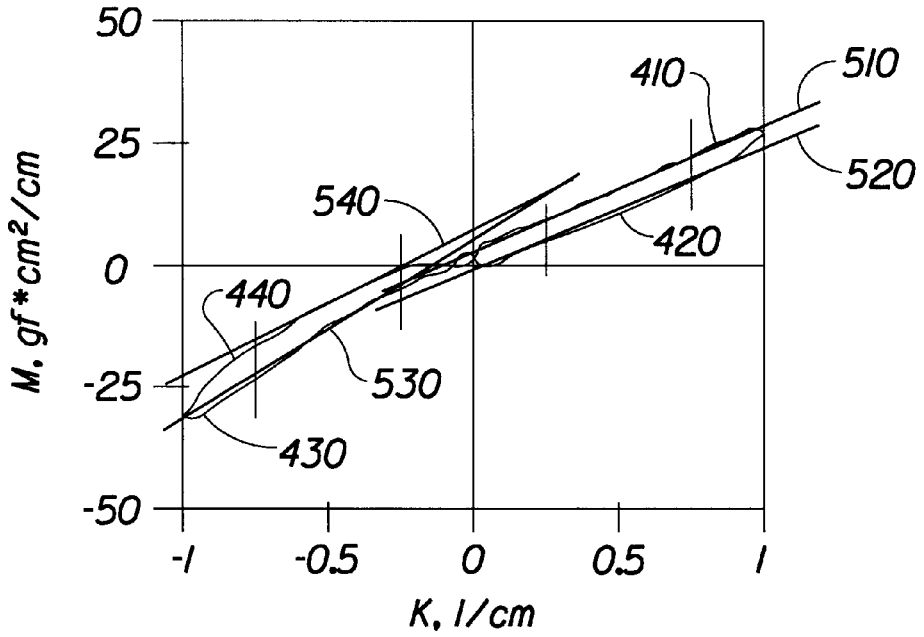
FIG. 5 is a typical graphical representation of linear regression lines produced for a bending stiffness test.

The data were analyzed in the following manner. A linear regression line was obtained between approximately 0.2 and 0.7 $cm^{-1}$ for the Forward Bend (FB) and the Forward Bend Return (FR). A linear regression line was obtained between approximately −0.2 and −0.7 $cm^{-1}$ for the Backward Bend (BB) and the Backward Bend Return (BR), as shown FIG. 5 which shows linear regression lines between 0.2 and 0.7 $cm^{-1}$ for the Forward Bend (FB) Forward Bend Return (FR) and between −0.2 and −0.7 $cm^{-1}$ for the Backward Bend (BB) and the Backward Bend Return (BR). The slope of the line is the Bending Stiffness (B). It has units of gf*$cm^2$/cm.

This was obtained for each of the four cycles for each of the four segments. The slope of the each line was reported as the Bending Stiffness (B). It has units of gf*$cm^2$/cm. The Bending Stiffness of the Forward Bend was noted as BFB.

The individual segment values for the four cycles were averaged and reported as an average BFB, BFR, BBF, BBR. Two separate samples in the MD and the CD were run. Values for the two samples were averaged together. MD and CD values were reported separately. The values are reported in Table 2.

TABLE 2

Bending Stiffness (Rigidity) Values

| | | Bending Stiffness ($gf*cm^2/cm$) | | | | |
|---|---|---|---|---|---|---|
| SAMPLE | MD/CD | AVG BFB | AVG BFR | AVG BBF | AVG BBR | AVG AVG |
| Monolayer | MD | 2.78 | 2.73 | 3.20 | 3.12 | 2.96 |
| Monolayer | CD | 4.14 | 3.99 | 4.88 | 4.82 | 4.46 |
| Dual layer I | MD | 31.69 | 25.52 | 35.42 | 36.97 | 32.40 |
| Dual layer I | CD | 6.72 | 6.35 | 7.68 | 7.10 | 6.96 |
| Dual layer II | MD | 50.87 | 51.30 | 60.93 | 65.63 | 57.37 |
| Dual layer II | CD | 19.38 | 18.75 | 23.36 | 22.92 | 21.10 |
| Triple layer I | MD | 8.88 | 8.57 | 11.27 | 10.28 | 9.75 |
| Triple layer I | CD | 18.61 | 17.47 | 17.26 | 16.86 | 17.55 |
| Present Invention I | MD | 12.13 | 11.02 | 13.69 | 12.63 | 12.37 |
| Present Invention I | CD | 9.10 | 8.80 | 9.85 | 9.03 | 9.20 |
| Present Invention II | MD | 28.98 | 25.26 | 35.88 | 34.47 | 31.15 |
| Present Invention II | CD | 21.06 | 19.85 | 24.97 | 24.62 | 22.62 |

Figure 6:
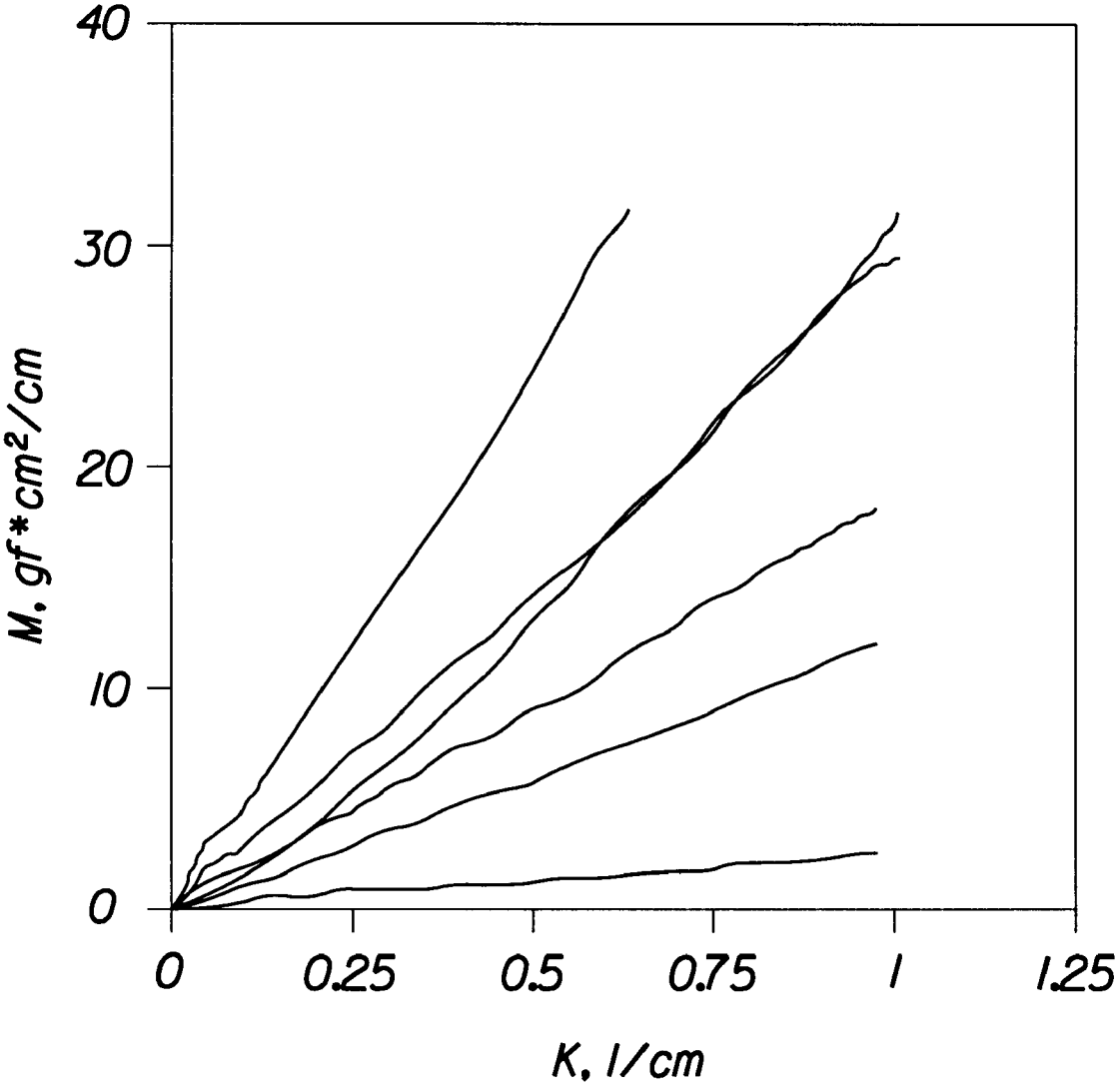
FIG. 6 is a typical graphical representation of representative force displacement curves for samples tested in the bending stiffness test.

A representative example of the Forward Bend of five MD samples is depicted in FIG. 6.

Caliper

The caliper, or thickness, t, of the reinforcing structure 12 is measured using an Emveco Model 210A digital micrometer made by the Emveco Company of Newburg, Oreg., or similar apparatus, using a 3.0 psi loading applied through a round 0.875 inch diameter foot. The reinforcing structure 12 is loaded to 20 pounds per lineal inch in the machine direction while tested for thickness. The reinforcing structure 12 should be maintained at about 70° F. during testing.

Void Volume

Void volume of the reinforcing structure, prior to application of the pattern layer is determined by the following method. A four-inch square (16 $in^2$) piece of reinforcing structure is measured for caliper (by the method above) and weighed. The density of the constituent yarns is determined; the density of the void spaces is assumed to be 0 gm/cc. For polyester (PET) a density of 1.38 gm/cc is used. The four-inch square is weighed, thereby yielding the mass of the test sample. Void volume per square inch of reinforcing structure is then calculated by the following formula (with unit conversions where appropriate):

$$\text{Void Volume} = V_{total} - V_{yarns}$$

$$= (t \times A) - (m/\rho)$$

where, $V_{total}$=total volume of test sample $V_{yarns}$=volume of the constituent yarns alone t=caliper of test sample A=area of test sample m=mass of test sample ρ=density of yarns Void volume per square inch of reinforcing structure is then calculated by dividing the calculated void volume by the area (16 $in^2$) of the test sample (again, assuring that all units are converted and consistent).

While other embodiments of the invention are feasible, given the various combinations and permutations of the foregoing teachings, it is not intended to thereby limit the present invention to only that which is shown and described above.

What is claimed is:

1. A papermaking belt comprising:

a reinforcing structure comprising:

a web facing first surface of interwoven first machine direction yarns and cross-machine direction yarns, said first surface having a Fiber Support Index of at least about 68;

a machine facing second surface comprising second machine direction yarns binding only with said cross-machine direction yarns in a N-shed pattern, where N is greater than four;

wherein said second machine direction yarns bind only one of said cross-machine direction yarns per repeat; and a pattern layer facing outwardly from said first surface, wherein said pattern layer provides a web contacting surface facing outwardly from said first surface, said pattern layer extending at least partially to said second surface.

2. A papermaking belt of claim 1, wherein said first machine direction and cross-machine direction yarns of said first surface having a Fiber Support Index of at least 80.

3. A papermaking belt of claim 1, wherein said first machine direction and cross-machine direction yarns of said first surface having a Fiber Support Index of at least 95.

4. A papermaking belt of claim 1, wherein said first machine direction and cross-machine direction yarns of said first surface comprise a square weave.

5. A papermaking belt of claim 1, wherein said machine facing second surface comprises second machine direction yarns binding only with said cross-machine direction yarns in a N-shed pattern, where N is greater than seven.

6. A papermaking belt of claim 1, wherein said machine facing second surface comprises second machine direction yarns binding only with said cross-machine direction yarns in a 1, 4, 7, 2, 5, 8, 3, 6 warp pick sequence.

7. A papermaking belt of claim 1, wherein said first machine direction and cross-machine direction yarns of said first surface comprise a 2-shed square weave and said machine facing second surface comprises second machine direction yarns binding once per repeat only with said cross-machine direction yarns in a N-shed pattern, where N is greater than seven.

8. A papermaking belt of claim 1, wherein said first machine direction and cross-machine direction yarns of said first surface comprise a 2-shed square weave and said machine facing second surface comprises second machine direction yarns binding once per repeat only with said cross-machine direction yarns in a N-shed pattern, where N is greater than seven, and said second machine direction yarns binding only with said cross-machine direction yarns in a 1, 4, 7, 2, 5, 8, 3, 6 warp pick sequence.

9. A papermaking belt of claim 1, wherein said first machine direction yarns, said cross-machine direction yarns, and said second machine direction yarns each have generally circular cross-sections.

10. A papermaking belt of claim 1, wherein said first machine direction yarns, said cross-machine direction yarns, and said second machine direction yarns each comprise materials chosen from the group consisting of polyester, or polyamide.

11. A papermaking belt of claim 1, wherein said first machine direction yarns, said cross-machine direction yarns, and said second machine direction yarns each comprise the same material.

12. A papermaking belt of claim 1, wherein said belt is a forming belt for use in the forming section of a paper machine.

13. A papermaking belt of claim 1, wherein said belt is a press felt for use in the press section of a paper machine.

14. A papermaking belt of claim 1, wherein said belt is a drying belt for use in the drying section of a paper machine.

15. A papermaking belt of claim 1, wherein said belt is for use in a crescent former.

* * * * *